United States Patent [19]

Peloggio

[11] Patent Number: 4,577,573

[45] Date of Patent: Mar. 25, 1986

[54] PRECISION-STITCH SEWING MACHINE

[75] Inventor: Alessandro Peloggio, Brignano Gera D'Adda, Italy

[73] Assignee: Exacta S.p.A., Brignano Gera D'Adda, Italy

[21] Appl. No.: 567,837

[22] Filed: Jan. 3, 1984

[30] Foreign Application Priority Data

Jan. 10, 1983 [IT] Italy ..... 19044 A/83

[51] Int. Cl.[4] ..... D05B 27/10; D05B 27/00

[52] U.S. Cl. ..... 112/318; 112/314; 112/322

[58] Field of Search ..... 112/318, 322, 121.26, 112/121.27, 312, 313, 314, 319, 1

[56] References Cited

U.S. PATENT DOCUMENTS

| | | | |
|---|---|---|---|
| 2,325,643 | 8/1943 | Weis | 112/322 |
| 2,586,764 | 2/1952 | Nelson | 112/318 |
| 2,706,457 | 4/1955 | Galkins | 112/318 |
| 2,723,636 | 11/1955 | Galkins | 112/318 |
| 2,955,553 | 10/1960 | Winberg | 112/318 |
| 3,960,097 | 6/1976 | Block | 112/322 |
| 4,086,687 | 5/1978 | Smith, II | 26/18.6 |
| 4,102,282 | 7/1978 | Hsiao et al. | 112/322 |
| 4,290,376 | 9/1981 | Brusasca et al. | 112/322 |

*Primary Examiner*—Werner H. Schroeder
*Assistant Examiner*—Joseph S. Machuga
*Attorney, Agent, or Firm*—Guido Modiano; Albert Josif

[57] ABSTRACT

The invention is concerned with the technical field of machines for attaching knit or woven fabric hems to generally knit wearing apparel, and in particular, relates to a machine designed to perform such operations by precision-stitch sewing. To retain a constant match of the loops forming a lower flap in a folded hem with the loops in the upper flap while sewing the hem onto wearing apparel, the machine comprises a sewing assembly with which a hem entraining assembly and feeding assembly for a garment to be sewn are arranged to cooperate, and is characterized in that said entraining assembly includes a pair of entraining members defining a hem passageway therebetween and being kinematically connected to attain substantially equal and oppositely directed peripheral velocities.

6 Claims, 4 Drawing Figures

PRECISION-STITCH SEWING MACHINE

BACKGROUND OF THE INVENTION

This invention relates to a precision-stitch sewing machine, particularly useful for attaching hems to wearing apparel.

As is known, the attachment of hems to garments or articles of clothing is generally performed on linking machines, which have an annular set of needles arranged to rotate in synchronization with a linking assembly and to which a hem is fed which may be folded over a flap of a garment being sewn.

Such an operation, in view of its high cost, can only be justified where a high quality finish work is sought, and in most instances, hems are instead applied by means of sewing machines.

In the latter case, sewing machines may include a feeding assembly for feeding in a garment to be sewn which cooperates with a hem entraining assembly for an optionally folded hem, the latter assembly being located upstream of a sewing assembly, thereby an edge or flap of the garment to which the hem is to be attached is enveloped between two flaps of the folded over hem.

The entraining action is applied to the hem via claws or entraining belts, and on one flap of the folded hem, in general the lower flap thereof.

Consequently, already after a short length of the hem has been sewn, the upper flap, which is initially set to exactly match the lower flap, tends to move out of alignment with the latter owing to the friction exerted between said upper flap and pressure shoe of the sewing assembly, and owing to its entrainment solely relying on cooperation with the entrainment action exerted on the lower flap. This results in the need for frequent manual interventions to restore the two flaps to their proper positions and in the likelihood or faulty seams which lower the value of the article of clothing produced.

It may also be important to differentiate the feed rate of the garment from the entrainment rate of the hem, in order to impart the produced garment with different degrees of elasticity at areas thereof whereat stresses are more likely to occur.

SUMMARY OF THE INVENTION

In the light of the above-mentioned technical problems, it is a primary object of this invention to obviate such prior shortcomings by providing a precision-stitch sewing machine which can retain a perfect match between flaps of a folded hem even over long sewn seams.

Another object of the invention is to provide for differentiation of the hem entrainment rate from the feed rate of a garment to be sewn.

It is a further object of the invention to provide a machine which can operate both on an open knit garment article, that is one which can be fed in a spread condition over a surface, and on a finished garment article having, accordingly, a substantially tubular configuration.

A not unimportant object of the invention is to provide a precision-stitch sewing machine which is simple, functional, and capable of ensuring a quite similar result to that provided by the more expensive linking operation, while keeping the processing time involved significantly short.

These and other objects are achieved by a precision-stitch sewing machine for attaching hems to wearing apparel, which comprises a sewing assembly cooperating with a hem entraining assembly and a feeding assembly for an article of clothing to be sewn, said assemblies being interconnected operatively, and is characterized in that said entrainment assembly comprises a pair of entraining members defining a passageway for said hems therebetween and being kinematically connected to attain substantially equal and oppositely directed peripheral velocities.

BRIEF DESCRIPTION OF THE DRAWINGS

Further features and advantages of the invention will be more readily understood from the following detailed description of a precision-stitch sewing machine according to the invention, as illustrated by way of example and not of limitation in the accompanying drawings, where.

DESCRIPTION OF THE PREFERRED EMBODIMENTS

Figure 1:
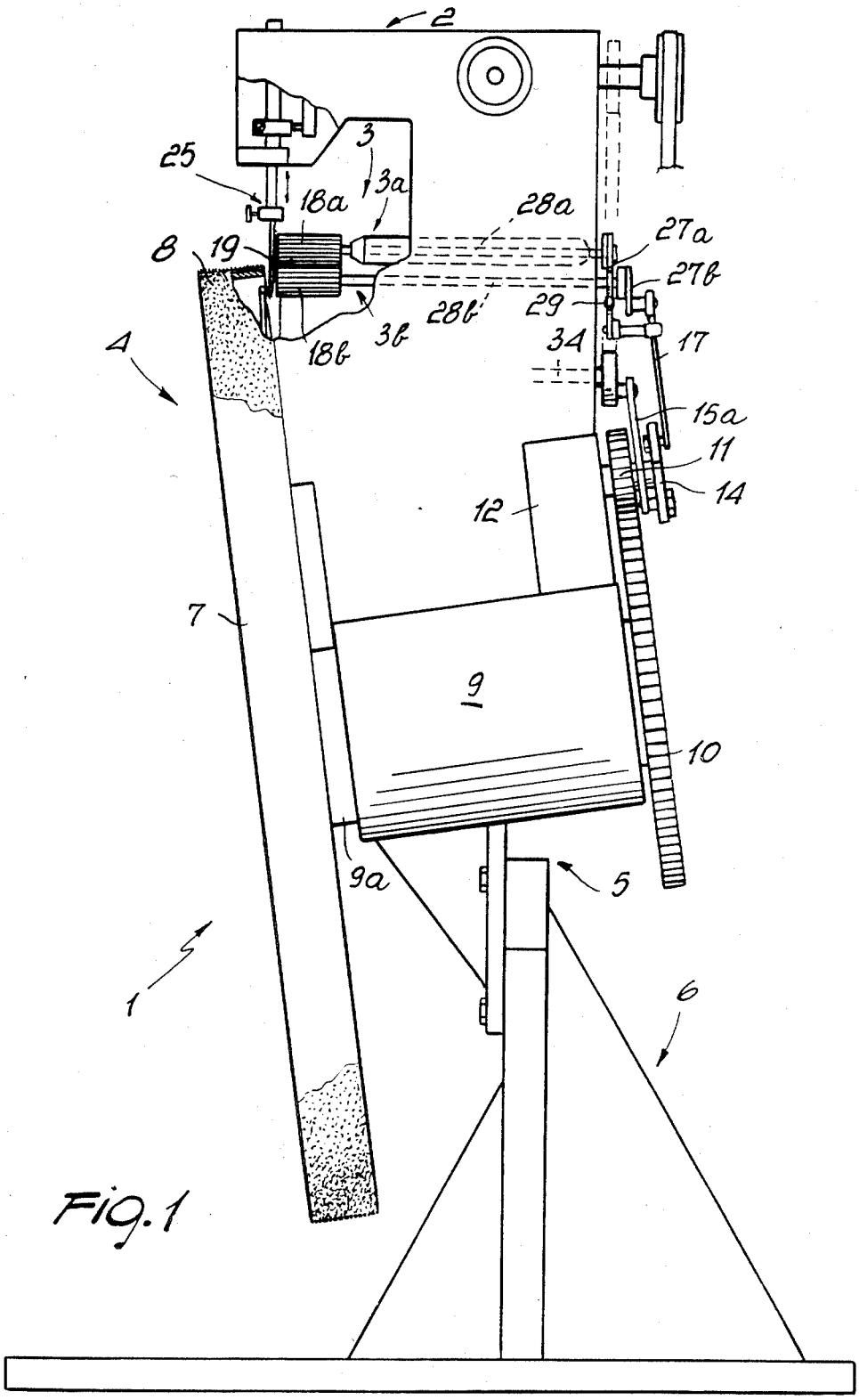
FIG. 1 is a schematical view in side elevation of the sewing machine according to the invention.

Making reference to the drawing views, the machine of this invention is generally designated with the reference numeral 1.

It comprises essentially a sewing assembly 2, cooperating with a hem entraining assembly 3 and a feed assembly for an article of clothing or garment to be sewn, indicated at 4.

The cited assemblies are carried on a structure 5 supported by a frame 6; the structure 5 carries rotatably the feed assembly 4 for the garment to be sewn, which includes essentially and entrainment wheel 7 optionally provided, at the periphery thereof, with a garment catching liner 8, e.g. in the form of an adhesive tape or tape formed with a hooked pile; the entrainment wheel 7 is connected, through a shaft 9*a* passing through a bearing bushing 9, to a drive member 10, comprising for example a gear meshing with a driving wheel 11 connected rotatably to a support 12, e.g. attached to the bushing 9. The wheel 11 is connected, via a unidirectional clutch device, such as an automatic release clutch 13, to an actuating lever 14 having a first groove 15 and second groove 16. Engaged with the first groove 15 in an adjustable manner is an actuating connecting rod 15*a*, receiving active motion through a conventional crank mechanism from the sewing assembly of the machine 1; a rod 17, connected to the second groove 16, cooperates with the entrainment assembly 3.

Figures 2, 3, 4:
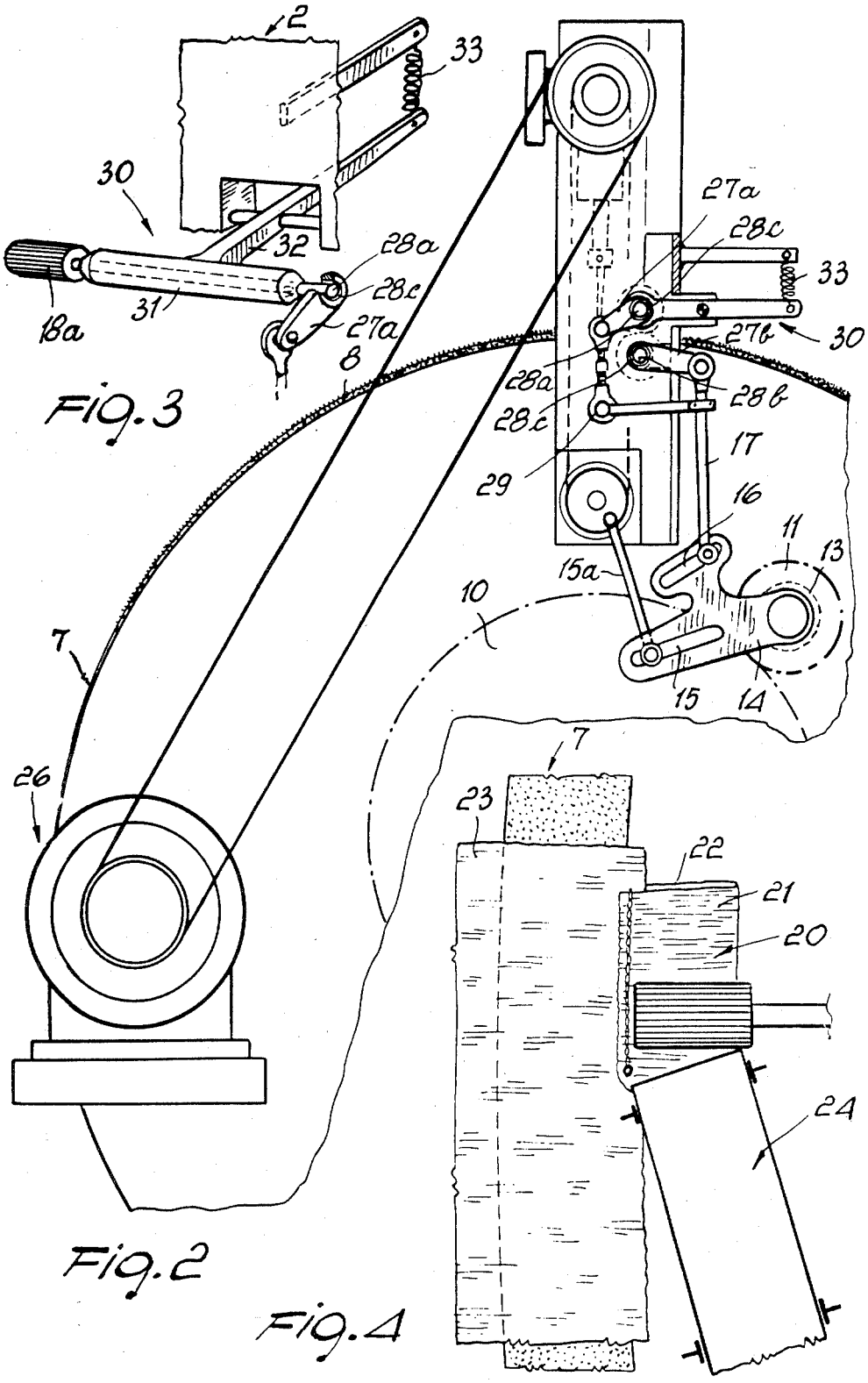
FIG. 2 is a rear elevation view showing schematically that same machine.
FIG. 3 is a detail view of the entraining members.
FIG. 4 illustrates diagramatically how the entrainment assembly operates.

Said assembly 3 essentially comprises a pair of entraining members, respectively 3*a* and 3*b*, carried rotatably on the sewing assembly and being preferably parallel to each other; each entraining member includes essentially a roller, respectively 18*a* and 18*b*, so arranged as to define between the roller pair 18*a*, 18*b* a passageway 19 wherethrough a folded hem 20 can be inserted, as shown in FIG. 4, to have an upper flap 21 and lower flap 22 arranged to envelope a garment 23 carried on the wheel 7.

The hem 20 is fed into the sewing machine 1 in web form and may be folded over prior to going through the passageway 19 by a folding device 24, carried on the sewing assembly 2.

The rollers 18*a*, 18*b* are held away from the entraining wheel 7 to allow a needle 25 to be reciprocated therebetween. The needle is driven conventionally by a motor 26 to sew the hem 20 and garment 23 together.

Each roller 18*a*, 18*b* receives active entrainment motion for the hem 20 through a crank lever, 27*a* and 27*b* respectively, which may be rigid with shafts 28*a* and 28*b*.

Interposed between each crank lever 27*a*, 27*b* and each roller 18*a*, 18*b* is a unidirectional engagement means 28*c*, also preferably in the form of an automatic release device, thereby the rollers 18*a*, 18*b* can only apply their entrainment action each in one direction, they being released from their corresponding crank levers 27*a*, 27*b* as the latter are driven in the opposite direction.

The crank lever 27*b* is connected directly to the rod 17, whereas the crank lever 27*a* is connected to that rod via connection means 29 and arranged to face away from the former crank lever, so as to impart the roller 18*a* with an oppositely directed rotation with respect to the roller 18*b*, thus providing for the entrainment of the hem 20.

To facilitate the insertion of the hem 20 through the passageway 19, the shaft 28*a* is supported by a bracket 30, defining a bushing portion 31 in engagement with said shaft 28*a*, and a supporting portion 32 made rigid with the portion 31 and being journalled on the sewing assembly 2 to allow separation of the rollers 18*a*, 18*b* during the preliminary stage of sewing machine preparation, and then returning the rollers 18*a*, 18*b* to contact the hem 20.

In order to provide a sufficiently strong contact to prevent the hem 20 from slipping relatively to the rollers 18*a*, 18*b*, an elastic bias means 33 is provided which is connected to the end of the portion 32 remote from the portion 31.

The end of the connecting rod 15*a* remote from the first groove 15 is preferably connected to a conventional lower sewing assembly 34, which is operative to form sewing stitches in cooperation with the needle 25. This lower assembly 34, being known, has not been represented detail in the drawings.

The sewing machine according to the invention operates as follows: a garment to be sewn, 23, is placed on the entrainment wheel 7 where it is held in a preset position by the liner 8.

Then, the rollers 18*a*, 18*b* are moved apart by acting on the bracket 30 to enable the insertion of a hem 20 through the passageway 19; prior to this, the hem 20 has been passed through the device 24 to cause it to be folded over a flap of the garment 23 to be sewn, enveloping it.

Then, the motor 26 is started which causes the needle 25 to reciprocate in a vertical direction and drives, accordingly, the device 34 kinematically linked thereto; through the driving connecting rod 15*a*, the reciprocating motion is transmitted to the actuating lever 14 which, by acting on the automatic release wheel 13, causes the drive wheel 11, and consequently the drive member 10, to move forward step-wise and produce the entrainment wheel 7 feed movement.

A like reciprocating motion is transmitted to the second groove 16 and rod 17, which transfers said motion equally on both crank levers 27*a* and 27*b*, causing a rotation of the rollers 18*a*, 18*b* in synchronism with the rotation of the entrainment wheel 7 and movement of the needle 25.

The angular displacement of the rollers 18*a*, 18*b* at each active stroke of the needle 25 may be changed by positioning the end of the rod 17 connected thereto at different locations in the second groove 16.

This enables the entrainment rate of the hem 20 to be changed relatively to the feed rate of the garment 23 to be sewn, thus achieving seams having greater or lesser elastic properties according to necessity.

By virtue of the automatic release device 28*c* interposed between the rollers 18*a*, 18*b* and the crank levers 27*a*, 27*b*, the rollers receive their motion through the rod 17 in one direction only, and remain still as the rod 17 completes its return stroke.

On completion of the sewn seam, it will be sufficient to again act on the bracket 30 to move the rollers 18*a*, 18*b* apart and withdraw the finished article.

The advantages of having both flaps of the hem entrained as explained are self-evident: in fact, the arrangement is effective to prevent mismatching of the upper flap with respect to the lower flap, thus making it largely unnecessary for the operator to monitor the operation, but allowing the operator to concentrate solely on proper operation of the machine and not requiring him to correct any unevenly sewn spots resulting from the hem lower and upper flaps being driven at different rates.

Furthermore, the faculty of changing the hem entrainment rate relatively to the feed rate of the garment in a simple manner affords additional advantages where garments meeting particular elasticity requirements are sought.

The sewing machine, as described and illustrated herein, is susceptible to many modifications and changes without departing from the scope of the instant inventive concept. Thus, as an example, the drive components may be differently embodied provided that they are able to impart the cited actuation movements. All of the details, moreover, may be replaced with other, technically equivalent elements.

In practicing the invention, the materials used and the dimensions and contingent shapes may be any selected ones to meet individual application requirements and in accordance with the state of the art.

I claim:

1. A precision stitch sewing machine for attaching hems to wearing apparel, comprising: a bearing frame; motor means carried on said frame; a sewing assembly carried on said frame and kinematically connected to and receiving its motion from said motor means; a feeding assembly for an article of clothing to be sewn carried on said frame substantially beneath said sewing assembly; a hem entrainment assembly carried on said frame adjacent to said feeding assembly, said hem entrainment assembly comprising a pair of entrainment rollers defining a passage for the hems therebetween; and drive means carried on said frame and interposed between said sewing assembly and said entrainment rollers, said drive means comprising rate changing means for changing the hem entraining rate relatively to the apparel feeding rate and control means arranged between said rate changing means and each of said rollers for moving said entrainment rollers in substantially equal and oppositely directed peripheral speeds, said rate changing means comprising an actuating lever kinematically connected to said sewing assembly for receiving its motion therefrom and to said feeding assembly for transferring its motion thereto, said rate changing means further comprising at least one rod adjustably interposed between said actuating lever and said control means for controlling the actuation rate of said control means.

2. A sewing machine according to claim 1, wherein said control means comprises at least one crank lever connected with an end thereof to said rod and a unidirectional engagement means interposed between another end of said crank lever and one of said rollers, respectively.

3. A sewing machine according to claim 2, wherein said engagement means includes an automatic release wheel.

4. A sewing machine according to claim 1, wherein said drive means further comprises a drive wheel pivotally connected to said actuating lever through a unidirectional engagement device and meshing with an entrainment wheel of said feeding assembly.

5. A sewing machine according to claim 4, wherein said unidirectional engagement device comprises an automatic release wheel.

6. A sewing machine according to claim 4, wherein said entrainment wheel is provided peripherally with a hold-back liner.

* * * * *